US008479778B2

(12) United States Patent
Kühl et al.

(10) Patent No.: US 8,479,778 B2
(45) Date of Patent: Jul. 9, 2013

(54) WEAVING MACHINE AND METHOD FOR THREE-DIMENSIONAL WEAVING

(75) Inventors: Thomas Kühl, Inzigkofen (DE); Frank Durst, Albstadt (DE); Eckhard Fehrenbacher, Tübingen (DE)

(73) Assignee: Groz-Beckert KG, Albstadt (DE)

( * ) Notice: Subject to any disclaimer, the term of this patent is extended or adjusted under 35 U.S.C. 154(b) by 118 days.

(21) Appl. No.: 13/097,652

(22) Filed: Apr. 29, 2011

(65) Prior Publication Data

US 2011/0265905 A1 Nov. 3, 2011

(30) Foreign Application Priority Data

Apr. 29, 2010 (EP) ..... 10161488

(51) Int. Cl.
*D03D 11/00* (2006.01)
*D03D 41/00* (2006.01)

(52) U.S. Cl.
USPC ..... 139/11; 139/408; 139/415; 139/DIG. 1

(58) Field of Classification Search
USPC ..... 139/11, 35, 48, 97–99, 383 R, 384 R, 139/386, 387 R, 408–415, DIG. 1
See application file for complete search history.

(56) References Cited

U.S. PATENT DOCUMENTS

| | | | | |
|---|---|---|---|---|
| 2,998,030 | A * | 8/1961 | Koppelman et al. | 139/387 R |
| 3,818,951 | A * | 6/1974 | Greenwood | 139/20 |
| 4,825,912 | A * | 5/1989 | Fleury et al. | 139/305 |
| 4,949,761 | A * | 8/1990 | Fleury et al. | 139/384 R |
| 5,085,252 | A * | 2/1992 | Mohamed et al. | 139/22 |
| 5,127,444 | A * | 7/1992 | Takano et al. | 139/52 |
| 5,137,058 | A * | 8/1992 | Anahara et al. | 139/384 R |
| 5,327,621 | A * | 7/1994 | Yasui et al. | 28/149 |
| 5,449,025 | A * | 9/1995 | Weinberg | 139/11 |
| 5,465,762 | A | 11/1995 | Farley | |
| 6,000,442 | A * | 12/1999 | Busgen | 139/389 |
| 6,003,564 | A | 12/1999 | Cahuzac et al. | |
| 6,817,383 | B2 * | 11/2004 | Debaes et al. | 139/21 |
| 7,077,167 | B2 * | 7/2006 | Nayfeh et al. | 139/11 |
| 2003/0217780 | A1 * | 11/2003 | Uchida | 139/11 |
| 2005/0274426 | A1 * | 12/2005 | Nayfeh et al. | 139/11 |
| 2011/0155276 | A1 * | 6/2011 | Leppla et al. | 139/22 |
| 2012/0190257 | A1 * | 7/2012 | Siebert | 442/239 |

FOREIGN PATENT DOCUMENTS

| | | | |
|---|---|---|---|
| DE | 3915085 | A1 | 11/1990 |
| DE | 4137082 | A1 | 5/1993 |
| DE | 19816666 | A1 | 10/1999 |
| EP | 0302012 | A1 | 2/1989 |

(Continued)

*Primary Examiner* — Bobby Muromoto, Jr.
(74) *Attorney, Agent, or Firm* — Fitch, Even, Tabin & Flannery, LLP

(57) ABSTRACT

A weaving machine and a weaving method for direct three-dimensional weaving, wherein the weft thread (32) is imparted with its desired two-dimensional course already when the weft thread is being input. The position of the warp threads (12) is adapted to the weft thread path (23). The weft thread path (23) is defined by the lamellae (44) that extend into the shed (21) in between the warp threads (12). The lamellae (44) are arranged on a common bar (45) so that they can be individually adjusted, thus enabling the adjustment of the desired weft thread path (23) by positioning the lamellae (44). The lamellae (44) and the bar (45), at the same time, form the reed (43) that is used for casting on the weft thread (32) at the fabric edge (16).

15 Claims, 3 Drawing Sheets

FOREIGN PATENT DOCUMENTS

| | | | |
|---|---|---|---|
| EP | 0819188 | A1 | 1/1998 |
| EP | 0922198 | A1 | 6/1999 |
| WO | 9631643 | A1 | 10/1996 |

* cited by examiner 13
12
12
12

WEAVING MACHINE AND METHOD FOR THREE-DIMENSIONAL WEAVING

CROSS-REFERENCE TO RELATED APPLICATION

The present application claims the priority of European Patent Application No. 10 161 488.1, filed Apr. 29, 2010, the subject matter of which, in its entirety, is incorporated herein by reference.

BACKGROUND OF THE INVENTION

The invention relates to a weaving machine and a method for three-dimensional weaving. Woven fabrics are a frequently used as reinforcing means in composite materials. In doing so, the fabric fibers are preferably subject to tensile loading. Referring to three-dimensionally formed components such as occur in automobile or ship body construction, the fabric incorporated in the composite material must be adapted to the desired component form.

This may be accomplished, for example, in that the whole fabric is cut into individual pieces that are then arranged so as to overlap on the three-dimensional component and are then incorporated by lamination. This process is time-consuming and expensive. Therefore, it has also been suggested to drape the two-dimensional fabric, in which case, however, stretched regions are formed and the fabric density in the stretched regions is reduced. Optionally, excess material must even be cut off or superimposed in pleats.

Mechanized methods and devices for the manufacture of three-dimensional fabrics have also been described.

From publication DE 41 37 082 C2 it has been known to provide a reed with reed lamellae that are arranged in casting-on direction and in weft thread direction in a manner that they can be shifted relative to each other. The warp threads are guided over the reed lamellae and their distance is adjusted so that a spatial contour can be obtained. A similar arrangement is also described in U.S. Pat. No. 5,465,762. The resultant contour changes the structure from a planar, two-dimensional form to a three-dimensional form during the abutment of the lamella. Such a weaving process is relatively slow. Frequently, it is necessary that the change into the three-dimensional form be supported by additional draping.

The author of publication EP 0 302 012 B1 suggests that a three-dimensional fabric form be produced by spherically shaped draw-off rollers. In doing so, the fabric is stretched after the weaving operation in order to achieve the desired form.

Considering the method known from EP 0 819 188 B1, a three-dimensionally formed fabric zone is formed in that the number of woven-in warp threads or weft threads varies, or that the type of weave is changed. The distance of the warp threads is achieved by changing the distance of the reed lamellae. The reed is fan-shaped, so that the distance between two adjacent reed lamellae varies. Therefore, by shifting the reed, the distance between two adjacent warp threads can be adjusted. The contour change is created by the reed during casting-on of the warp thread.

Publication DE 39 15 085 C2 describes a device for the manufacture of a three-dimensional fabric, wherein, between the shed-forming device and the drawing-off of the fabric a molded element is arranged upstream of the fabric edge, said molded element having the shape of the fabric form that is to be produced. The molded element may be made of several disks or, alternatively, of a series of adjustable tappets. Also in the case of this method, the desired form is created during the casting-on of the weft thread.

The object to be achieved by the invention may be viewed as the provision of a weaving machine, as well as a weaving method, that improve the until now known methods and devices for the manufacture of three-dimensional fabrics.

SUMMARY OF THE INVENTION

The above object generally is achieved according to a first aspect of the invention by a weaving machine for three-dimensional weaving, comprising, healds that are arranged parallel to each other, with each heald having a thread eye for a warp thread; a heald drive positioning the thread eyes of the healds independently of each other in a shed-changing direction; and lamellae extending between warp threads into the shed, which lamellae can be positioned independently of each other in the shed-changing direction and which are disposed to determine a two-dimensional warp thread path, along which the warp thread is input into the shed.

The above object generally is achieved according to a second aspect of the invention by a method for three-dimensional weaving, comprising the steps of: opening a shed, whose course follows a two-dimensional weft thread path, by positioning the warp threads; determining a two-dimensional weft thread path in the opened shed; and, moving the weft thread into the shed along the two-dimensional weft thread path.

In accordance with the invention, the three-dimensional fabric is woven directly. The weft thread is shot along a weft thread path into the opened shed. The weft thread path is curved transversely with respect to the shooting-in direction and thus has a two-dimensional form. In this manner, the three-dimensional fabric form is obtained already due to the course of the weft thread. In order to open the shed, the warp threads are preferably brought into a position, in which the warp threads positioned on the same side of the shed will follow the weft thread path. Thus, the opened shed is adapted to the contour of the warp thread path. In doing so, the distance of the warp threads from the weft thread path may be prespecified and, in particular, constant.

The weft thread path is preferably defined with the help of lamellae that extend between the warp threads into the opened shed. Each lamella may have a weft thread cutout that is open in the direction of the weaving edge. The weft thread cutouts of the lamellae are arranged in the shed along the weft thread path. When the weft thread is entered, the weft thread is transported through the weft thread cutouts of the lamellae and, in this manner, is imparted with its desired two-dimensional course. Thus, due to the weft thread cutouts, a weft thread channel is created for guiding the weft thread.

Preferably, the lamellae are located on a common bar. The lamellae are arranged on the bar so that they can be shifted in the direction of their extension. In this manner, the desired weft thread path may be adjusted very easily by shifting the lamellae relative to each other. The position of the lamellae can be changed after each weft thread entry. As a result of this, three-dimensional fabric forms with continuous transitions can be created. In the exemplary embodiment, the lamellae and the bar form the reed of the weaving machine. In order to cast on the weft thread, the reed is pivotally supported. Consequently, the lamellae are not only disposed to define the weft thread path but, at the same time, for casting on the weft thread at the fabric edge. Preferably, the lamellae are supported parallel to each other on the bar.

Healds are provided for shed formation, said healds being movable in shed-changing direction. As a result of this, the warp threads can be brought into the desired position. In a preferred exemplary embodiment, a heald drive is provided by means of which the healds can be positioned independently of each other in shed-changing direction. In order to form a shed having the contour adapted to the weft thread path, the warp threads of one group are positioned at a prespecified distance above the desired weft thread path, and the warp threads of another group are positioned at a prespecified distance under the weft thread path. In this manner, the desired shed opening angle is achieved.

On their ends opposite the heald drive, the healds are fastened to a common heald holder. Between the heald and the heald holder there is an elastic means, so that the heald is pulled by the elastic force of the elastic means toward the heald holder and can be moved away from the heald holder in the opposite direction by the heald drive. If the heald drive does not apply any force to the heald, the heald is brought into its rest position by the elastic means.

In order to vary the width of the produced three-dimensional fabric, it is also possible to grasp and divide one or move warp threads through one or more warp thread holders. For a potential subsequent reuse of the divided warp threads, it is possible to provide a holding device that can hold one or more, preferably all, of the warp threads of the warp thread group and keep them available. In this manner it is possible, for example, to vary the width of the produced fabric in shoot-in direction. It is also possible to remove individual warp threads from the center of the fabric, for example, if openings or zones without knotting points are to be provided in the fabric. With the help of a gripper, a robotic arm or the like, the removed and held available warp threads can also be again returned to the weaving process.

The weaving machine may also comprise a weft thread input device for entering the weft thread or comprise a cutting device for cutting the weft thread. The position of these two devices may be adapted to the desired weft thread path. Therefore, the weft thread input device and/or the cutting device are arranged so that they can be shifted in shed-changing direction. For adaptation to a changed width of the fabric in weft thread direction, the weft thread input device and/or the cutting device may also be arranged so that they can be shifted in weft thread input direction.

The transport of the weft thread along the two-dimensional weft thread path is preferably aided by fluid nozzles. The fluid nozzles are arranged between two lamellae and, in particular, on the bar. Specifically, the fluid nozzles are on the bar so that they can be shifted in shed-changing direction, so that the fluid stream generated by the fluid nozzle can be adapted to the respectively adjusted weft thread path.

Advantageous embodiments of the invention are obvious from the dependent patent claims, as well as from the description. The description is restricted to essential features of the invention. The drawings should be used for supplementary reference.

DETAILED DESCRIPTION OF THE INVENTION

Figure 4:
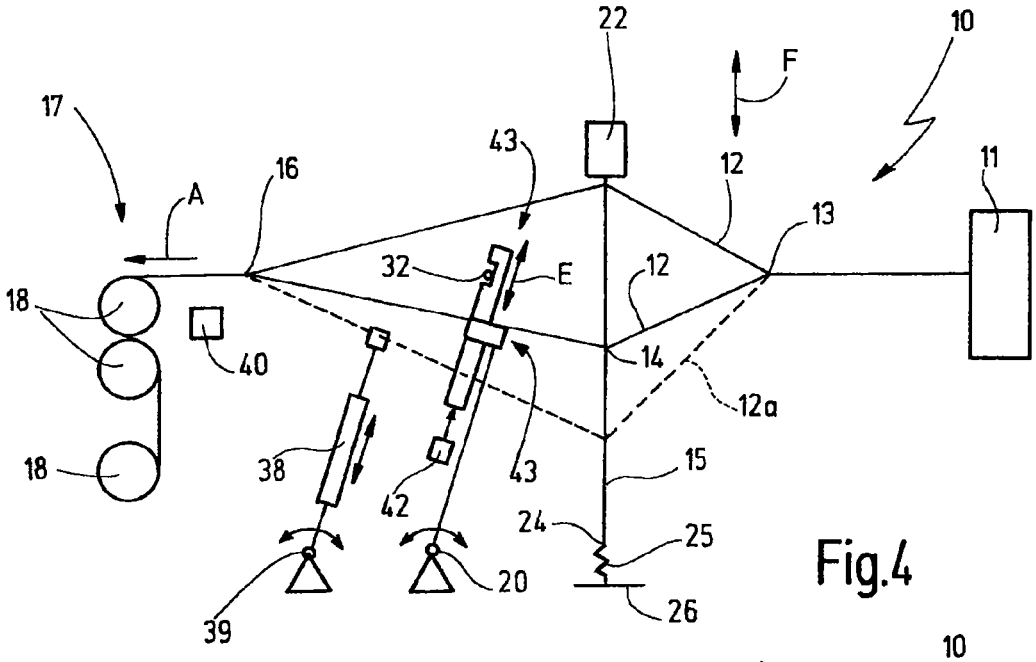
FIGS. 4 and 5 are schematic side views of a weaving machine represented in the manner of a block diagram.
Figure 5:
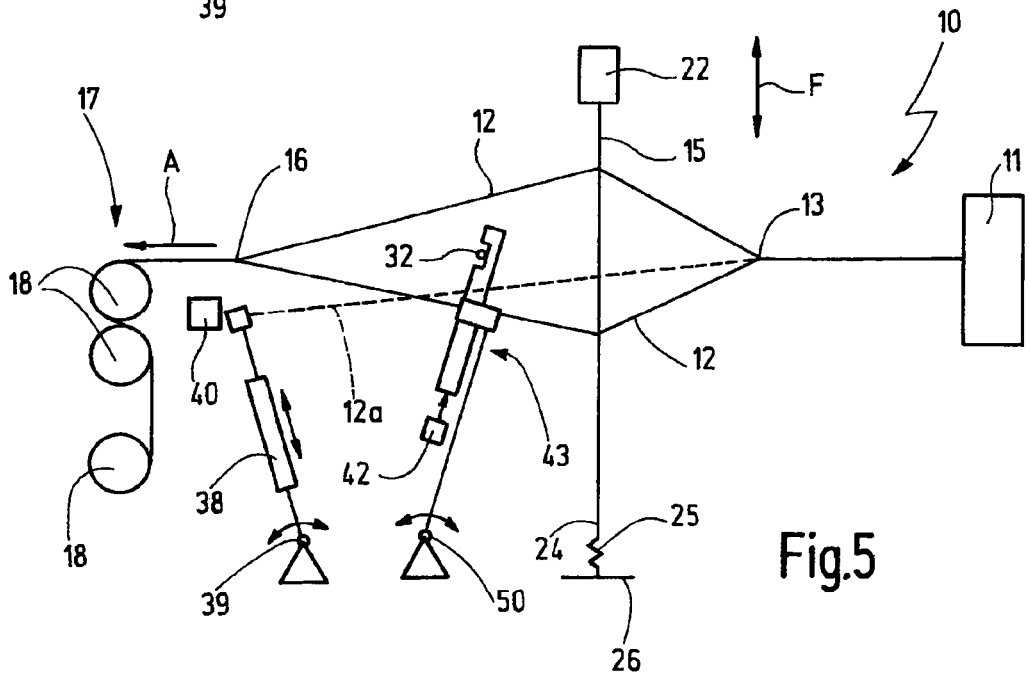

FIGS. 4 and 5 show a weaving machine 10 in the manner of a block diagram. The weaving machine 10 comprises a spool rack 11 by way of which the weaving machine 10 is supplied with warp threads 12. A holding rack 13 orders the warp threads 12 into one input direction R (FIG. 1), uniformly next to each other. Starting from the holding rack 13, each warp thread 12 extends through a thread eye 14 of a heald 15. The warp threads 12 further extend to a fabric edge 16 where the already woven, finished fabric ends. A draw-off device 17 pulls off the already produced fabric and, in doing so, ensures the transport of the warp thread 12 in draw-off direction A of the weaving machine 10. In the exemplary embodiment, the draw-off device 17 comprises several draw-off rollers 18 across the entire fabric width in input direction R, said draw-off rollers being able to form one or more pairs of rollers that can be resiliently pressed against each other. One or more of the draw-off rollers are driven.

Figure 2:
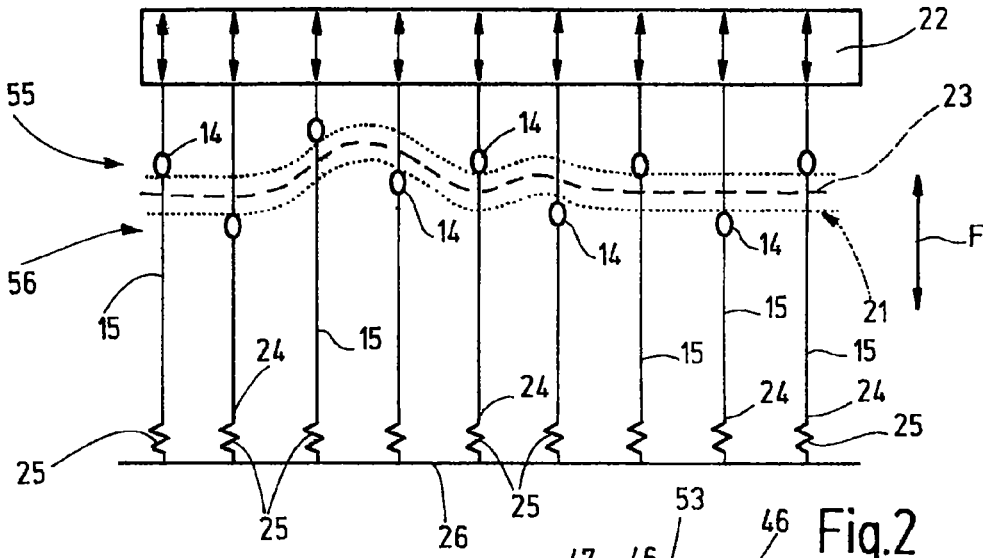
FIG. 2 is a schematic representation of the opened shed in warp thread direction.

A heald drive 22 is provided for forming a shed, each of the healds 15 being connected to said drive. The heald drive 22 can individually move each of the healds 15 and thus also its thread eye 14, and thus independently from each other in one shed-forming or shed-changing direction F. The position of the healds 15 or the thread eyes 14 depends on the set weave. For example, in case of a linen weave, adjacent thread eyes 14 in input direction R are alternately on one or the other sides of a weft thread path 23 (FIG. 2). FIG. 2 is a schematic representation of an opened shed 21 in the case of a linen weave. The heald drive 22 can, for example, be configured like the drive of a Jacquard machine, so that each heald 15 can be moved individually. It is also possible to use direct drives, for example linear drives as the heald drive 22.

On their ends 24 opposite the heald drive 22, the healds 15 are connected with a common heald holder 26 with an interposed elastic means 25. The heald drive 22 can remove the healds from the heald holder 26 against the force of the elastic means 25. If the heald drive 22 does not apply any force to a heald 15, said heald is in a rest position in which the thread eye 14 is at its smallest distance from the heald holder 26. The elastic means 25 may be helical springs, for example.

As an alternative to the individual heald drive, it is also possible to achieve shed formation with at least three heald shafts. In this case, each heald shaft has a heald drive 22, on which the healds 15 are movably arranged. Depending on the form of the 3D fabric that is to be woven—this resulting in different heights of the thread eyes 14 of the healds 15—one heald shaft may be provided for each thread eye level. On said heald shaft, it is possible to arrange several healds that can then be moved together in thread changing direction F.

Figure 1:
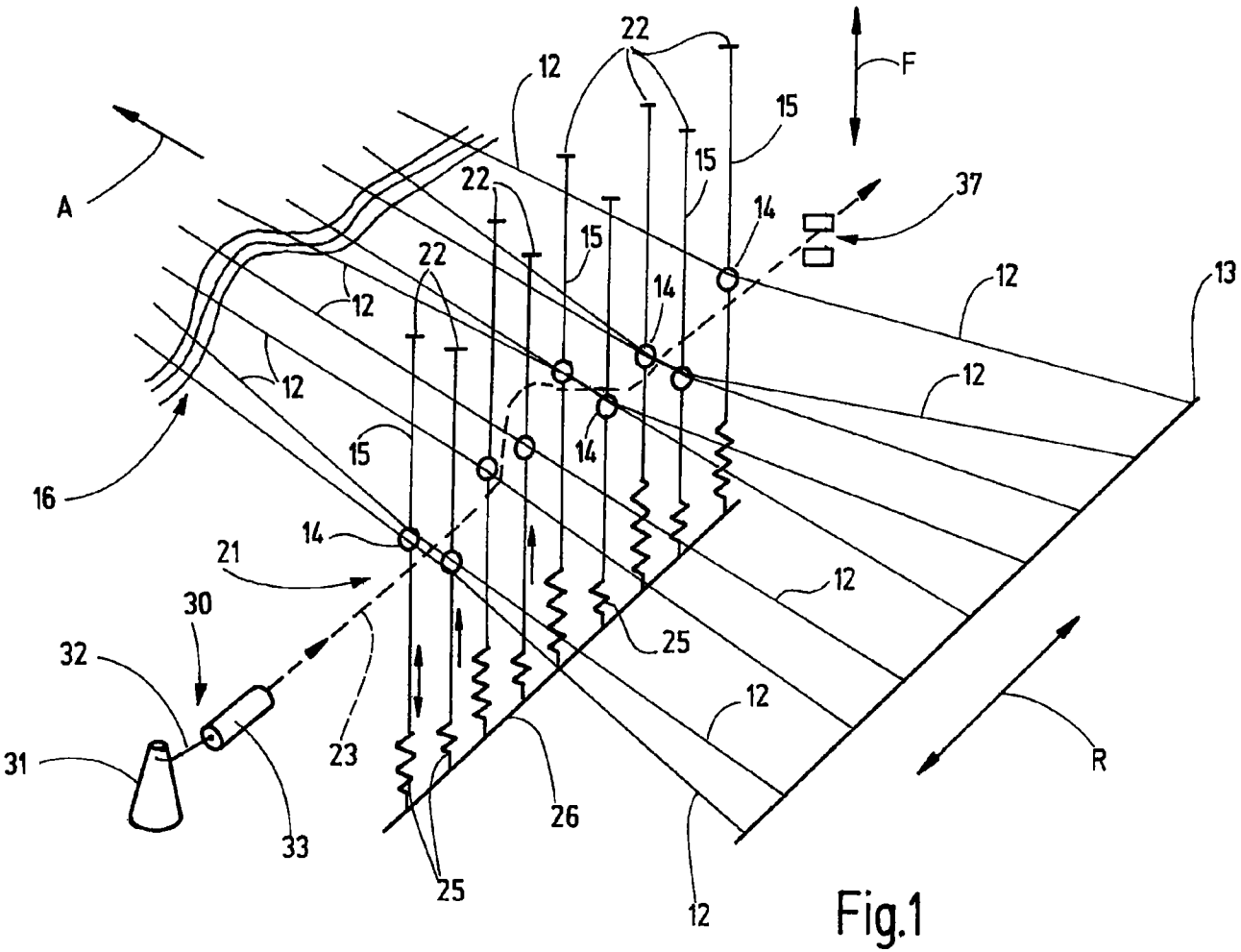
FIG. 1 is a schematic perspective representation of the shed formation.

As is obvious from FIG. 1, viewed in draw-off direction A of the warp threads 12, a input device 30 is arranged in extending the heald arrangement outside the warp thread group 12. The input device 30 is disposed for shooting a weft thread 32 into the opened shed 21. In the exemplary embodiment, the input device 30 comprises a spool body 31 for supplying the weft thread 32, as well as a cutting device (not illustrated) for cutting the weft thread 32 off the spool 31. The weft thread 32, in the exemplary embodiment described here, is shot in via a main nozzle 33 in weft thread input direction R. To accomplish this, the main nozzle 33 generates a fluid stream and preferably an air stream in weft thread input direction R, said stream carrying along the shot-in thread. Alternatively, the input device 30 could also comprise projectiles, shuttles or grippers.

On the side of the warp threads opposite the input device 30, there is a receiving device 37 that is disposed to receive and position the input weft thread 32.

The weaving machine 10 is able to take individual warp threads out of the weaving process. In the exemplary embodiment, the weaving machine 10 comprises one or more warp thread holders 38 that divide one or more individual warp threads 12 and hold them available in the region of the fabric edge 16 upstream of the draw-off device 17. To accomplish this, the warp thread can first be moved by the heald drive 22 out of the shed-forming region and be subsequently divided by the warp thread holder 38 and held in waiting position, as is schematically illustrated in the example by the warp thread 12*a* shown in dashed lines in FIGS. 4 and 5. The warp thread holder 38 can be moved for gripping and positioning the warp thread 12*a* that is to be divided. In accordance with the example, said warp thread holder is supported so that it can be pivoted about the first swivel axis 39 and in a radial direction relative to the first swivel axis 39. The weaving machine 10 may comprise several warp thread holders 38. They may also be arranged so that they can be moved in input direction R.

It is also possible for the weaving machine 10 to comprise a holding device 40 that can receive several warp threads. Preferably, the holding device 40 for each warp thread 12 of the warp thread group comprises means that create a warp thread holding position so that several separated warp threads 12*a* can be held individually and separately ready. With a warp thread holder 38 it is possible to remove several warp threads 12*a* of the warp thread group of warp threads 13 and feed them to the holding device. To accomplish this, the warp thread holder 38 is configured in such a manner that—independent of the position of said warp thread in the warp thread group—said holder can grasp a warp thread 12 to be taken out of the weaving process, cut said thread and transfer the end of said thread to the holding device. Preferably, the warp thread holder 38 comprises a bearing imparting it with a radial and linear mobility so that it can grasp a warp thread 12, independent of its position in the fabric, and feed it to the holding device. The warp thread grasping space of the warp thread holder 38 preferably extends across the entire width of the group of warp threads.

By removing the warp threads 12 from the weaving process it is possible, for example, to vary the width of the fabric in weft thread input direction R when the lateral warp threads 12 have been divided at the edge of the fabric to be produced by the warp thread holder 38 and been transferred to a waiting position. It is also possible to divide the non-edge-side warp threads 12 and remove them from the weaving process, for example when openings or knot-free zones are to be produced in the fabric. In doing so, it may be necessary to remove superfluous weft threads or weft thread sections from the center of the fabric after weaving.

If the stopped warp thread 12 is to again be fed to the weaving process, it may preferably be returned to the process by means of the warp thread holder 38 or by any other not specifically shown gripper device.

The warp thread holder 38 is preferably provided between a reed 43 and the fabric edge 16. In this manner it can be ensured that the warp thread is cut off only directly in the region of the fabric edge 16 and held so that the warp thread 12 is passed—as before—through the thread eye 14 of the heald 15 and the reed 43.

Figure 3:
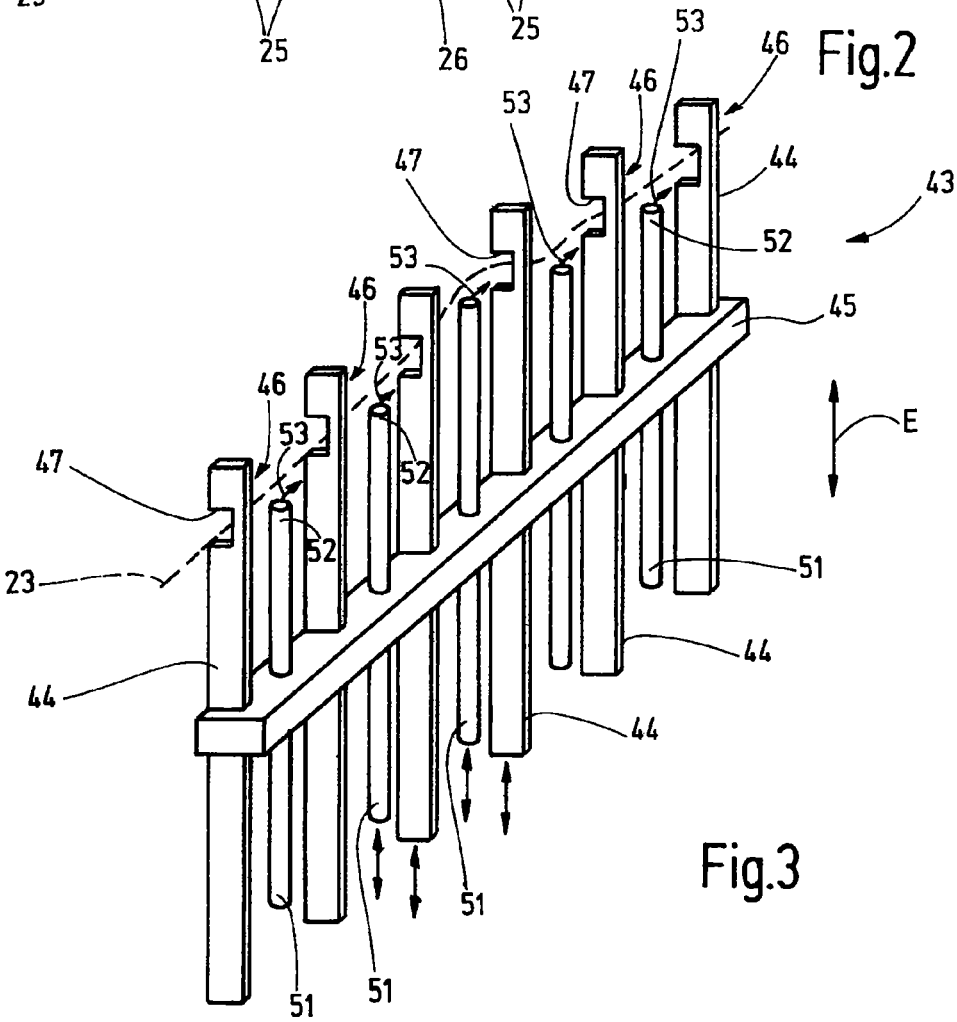
FIG. 3 is a schematic perspective representation of the lamellae for the adjustment of the desired weft thread path.

As is obvious from FIG. 3, the reed 43 has several parallel lamellae 44 that are arranged on a common bar 45 so that they can be shifted in their extension direction E. The lamellae 44 are positioned via an adjustment drive 42 (FIG. 4). In their end region 46 assigned to the warp threads 12, each lamella has a weft thread cutout 47. The weft thread cutout 47, in accordance with the example, is delimited by three sides of the lamella 44. The weft thread cutouts 47 are open in the direction toward the fabric edge 16. Referring to the exemplary embodiment, the weft thread cutouts 47 have the form of a parallelepiped. Preferably, the lamellae also have the contour of a parallelepiped. In modification of the described exemplary embodiment, it is also possible to vary the contour of the weft thread cutouts 47 and, viewed for example in cross-section, implement any polygonal or also rounded forms, in particular the form of a segment of a circle. It is also possible to modify the form of the lamellae 44.

The end regions 46 of the lamellae 44 extend into the opened shed 21. These end regions 46 determine the weft thread path 23 that is to be taken by the weft thread 32 through the opened shed 21. In accordance with the example, the weft thread cutouts 47 together define the weft thread path 23. The weft thread cutouts 47 form, as it were, a weft thread channel through which the weft thread 32 is guided along the weft thread path 23. As a result of the fact that the lamellae 44 are arranged on the bar 45 so that they can be shifted relative to each other, any curved weft thread path 23 through the shed 21 can be implemented. The weft thread path 23 thus is imparted with a two-dimensional course.

The reed 43 is supported so that it can pivot about a second swivel axis 50 (FIG. 4). After entering the weft thread, the reed 43 is pivoted toward the fabric edge 16 for casting on the weft thread 32 about the second swivel axis 50.

Fluid nozzles 51 can be arranged on the bar 45 between the lamellae 44. The fluid nozzles 51 generate a fluid stream along the weft thread path 23. To do so, the fluid nozzle 51 has, on its end 52 assigned to the weft thread cutout 47, a fluid exit opening that ejects the fluid in the direction of the adjacent weft thread cutout in transport direction of the weft thread 32. The fluid ejected by a fluid nozzle 51 is schematically illustrated by an arrow 53 in FIG. 3. The fluid nozzles 51 can be shifted parallel to the lamellae 44 in the extension direction E on the bar 45, so that the ends 52 comprising the fluid exit openings can be positioned outside the weft thread path 23. The end 52, for example, is arranged at a distance of a few millimeters or centimeters adjacent to the weft thread path 23. The adjustment drive 42 is disposed to position the fluid nozzles 51. Referring to the exemplary embodiment of the reed 43 shown here, a fluid nozzle 51 each is provided between two lamellae 44. However, the number of fluid nozzles 51 may also be lower. Preferably the fluid nozzles 51 generate an air stream.

The number of lamellae 44 of the reed 43 depends on the number of warp threads 12 that is used. Between two adjacent lamellae 44 there is at least one warp thread 12; in this case, also other divisions are possible, wherein two or more warp threads 12 run between adjacent lamellae 44.

The weaving machine 10 in accordance with the invention operates as follows:

The heald drive 22 moves the healds 15 and their thread eyes 14 into the required position in order to open the shed 21. In doing so, a first group of thread eyes 55 (FIG. 2) is, in shed-changing direction F, on the one side of the warp thread path 23, whereas a second group 56 of thread eyes 14 is arranged on the other side of the warp thread path 23, viewed in shed-changing direction F. The distance of the warp threads 12 of a group 55 or 56 running through the thread eyes 14 from the weft thread path 23 may be the same within one group 55 or 56. The result is that the opened shed has a constant opening width in the course of the warp thread path 23. It is also possible that the distances of the warp threads 12 of one or both groups 55, 56 moving through the thread eyes 14 vary and thus a shed 21 with a variable opening width is formed in the course of the weft thread path 23. The number and kind of thread eyes 14 belonging to the respective group 55 or 56 and the size of the distance assumed by these relative to the weft thread path 23 depend on the desired weave and the manner in which the shot is entered.

The lamellae 44 are positioned by means of an adjustment drive 42. In doing so, the weft thread cutouts 47 are arranged inside the opened shed 21 along the desired weft thread path 23. The adjustment drive 42 is also disposed to position the fluid nozzles 51.

Via the shot input device 30, the weft thread 32 is shot in and transported along the weft thread path 23 through the weft thread cutouts 47 of the lamellae 44. In doing so, the weft thread transport is aided by the fluid streams 53 from the fluid nozzles 51. The receiving arrangement 37 grasps and positions the weft thread. The entered weft thread 32 describes its desired course already before casting-on at the fabric edge 16 in order to produce a three-dimensional fabric that was prespecified by the weft thread path 23. In adaptation thereto, the warp threads 12 are also positioned. In this state, the weft threads 32 are cast on at the fabric edge 16 in that the reed 43 is pivoted about the second swivel axis 50.

After casting-on, the read 43 is again pivoted away from the fabric edge 16. The heald drive 22 initiates the positioning of the thread eyes 14 required for the next weft thread input. The adjustment drive 42 adjusts the lamellae 44 corresponding to the required weft thread path 23, whose course may be changed with respect to the course of the previous weft thread path and positions the fluid nozzles 51. The process begins anew. As a result, it is possible for a weft thread path 23 to be formed, the course of said path being different from one weft thread input to the next.

For adaptation to the weft thread path 23, the input device 30 and/or the receiving device 37 may be adjustably arranged in the shed-changing direction F. At last one of these two devices 30, 37 may also be adjust so as to be shiftable in the input direction R, when the length of the weft thread 32 is to be reduced, because the lateral warp threads 12 are taken out of the weaving process by appropriate warp thread holders 38, in order to produce a narrower fabric.

The invention relates to a weaving machine 10 and a weaving method for direct three-dimensional weaving, wherein the weft thread 32 is imparted with its desired two-dimensional course already when the weft thread is being input. The position of the warp threads 12 is adapted to the weft thread path 23. The weft thread path 23 is defined by the lamellae 44 that extend into the shed 21 in between the warp threads 12. The lamellae 44 are arranged on a common bar 45 so that they can be individually adjusted, thus enabling the adjustment of the desired weft thread path 23 by positioning the lamellae 44. The lamellae 44 and the bar 45, at the same time, form the reed 43 that is used for casting on the weft thread 32 at the fabric edge 16.

It will be appreciated that the above description of the present invention is susceptible to various modifications, changes and modifications, and the same are intended to be comprehended within the meaning and range of equivalents of the appended claims.

LIST OF REFERENCE NUMERALS

10 Weaving machine
11 Spool rack
12 Warp thread
13 Holding rack
14 Thread eye
15 Heald
16 Fabric edge
17 Draw-off device
18 Draw-off roller
21 Shed
22 Heald drive
23 Weft thread path
24 End of 15
25 Elastic means
26 Heald holder
30 Input device
31 Spool body
32 Weft thread
33 Main nozzle
37 Receiving arrangement
38 Warp thread holder
39 First swivel axis
40 Holding device
42 Adjustment drive
43 Reed
44 Lamella
45 Bar
46 End region of 44
47 Weft thread cutout
50 Second swivel axis
51 Fluis nozzle
52 End of 51
53 Arrow
55 First group of thread eyes
56 Second group of thread eyes
A Draw-off direction
E Extension direction
F Shed-changing direction
R Input direction

What is claimed is:

1. Weaving machine for three-dimensional weaving, comprising:

healds (15) that are arranged parallel to each other, each heald having a thread eye (14) for a warp thread (12);

a heald drive (22) positioning the thread eyes (14) of the healds (15) independently of each other in a shed-changing direction (F); and, lamellae (44) extending between warp threads (12) into the shed (21), which lamellae can be positioned independently of each other in the shed-changing direction (F) and which are disposed to determine a two-dimensional warp thread path (23), along which the warp thread (32) is input into the shed (21).

2. Weaving machine as in claim 1, characterized in that each of the lamellae (44) has a weft thread cutout (47 that is open toward a fabric edge (16), said lamellae determining the weft thread path (23).

3. Weaving machine as in claim 1, characterized in that the lamellae (44) are supported on a common bar (45) so that they can be shifted.

4. Weaving machine as in claim 1, characterized in that the lamellae (44) and the bar (45) form a reed (43).

5. Weaving machine as in claim 1, characterized in that the heald drive (22) positions a group (55) of the thread eyes (14) at a prespecified distance on the one side of the weft thread path (23) and another group (56) of the thread eyes (14) at a prespecified distance on the respectively other side of the weft thread path (23).

6. Weaving machine as in claim 1, characterized in that the healds (15) are fastened on their end (24) opposite the heald drive via an elastic means (25) to a heald holder (26).

7. Weaving machine as in claim 1, characterized in that a warp thread holder (38) is provided, said holder being able to grasp and divide a warp thread (12*a*).

8. Weaving machine as in claim 7, characterized in that the warp thread holder (38) is arranged between a reed (43) and a fabric edge (16).

9. Weaving machine as in claim 1, characterized in that a holding device (40) is provided, said device being able to receive a divided warp thread (12*a*).

10. Weaving machine as in claim 9, characterized in that the holding device (40) comprises means that can separately receive and hold available several divided warp threads (12*a*).

11. Weaving machine as in claim 1, characterized in that an input device (30) for entering the weft thread (32) and/or a receiving device (37) for receiving the weft thread (32) can be positioned in shed-changing direction (F).

12. Weaving machine as in claim 1, characterized in that a fluid nozzle (51) is arranged between two lamellae (44) in order to aid the weft thread transport.

13. Method for three-dimensional weaving, comprising:

opening a shed (21), whose course follows a two-dimensional weft thread path (23), by positioning warp threads (12), determining a two-dimensional weft thread path (23) in the opened shed (21), and, moving the weft thread (32) into the shed (21) along the two-dimensional weft thread path (23) defined by independently positioned lamellae (44) extending between the warp threads (12) of the shed (21).

14. Method as in claim 12, characterized in that the warp threads (12) delimiting the shed on one side are located in input direction (R) in a path that follows the course of the two-dimensional weft thread path (23).

15. Method as in claim 12, characterized in that the lamellae (44) extending between the warp threads (12) into the shed (21) are positioned independently of each other in such a manner that weft thread cutouts (47) of the lamellae (44) open toward a fabric edge (16) are located on the weft thread path (23) within the opened shed (21).

* * * * *